United States Patent [19]

Jarosinski

[11] Patent Number: 4,706,311

[45] Date of Patent: Nov. 17, 1987

[54] BATHTUB UNIT WITH IMPROVED USER FEATURES

[76] Inventor: Louis Jarosinski, 10457 Conrad St., Freedom, Wis. 54130

[21] Appl. No.: 863,458

[22] Filed: May 15, 1986

[51] Int. Cl.[4] ..... A61H 33/02

[52] U.S. Cl. ..... 4/546; 4/443; 4/571; 4/577; 4/590

[58] Field of Search ..... 4/538, 604, 590, 589, 4/546, 579, 577, 576, 443, 447, 420.3, 420.2, 571, 578, 445, 444

[56] References Cited

U.S. PATENT DOCUMENTS

| | | | |
|---|---|---|---|
| 580,367 | 4/1897 | Buick | 4/590 |
| 1,284,171 | 11/1918 | Barnhart | 4/590 |
| 1,432,916 | 10/1922 | Schwartz | 4/590 |
| 1,457,470 | 6/1923 | Steinkamp | 4/590 X |
| 1,546,536 | 7/1925 | Black | 4/590 |
| 1,940,514 | 12/1933 | Steinkamp | 4/590 |
| 1,962,076 | 6/1934 | Jadkowski | 4/590 |
| 2,005,576 | 6/1935 | Buhl et al. | 4/577 |
| 2,566,495 | 9/1951 | Miyakawa | 4/590 |
| 2,815,513 | 12/1957 | Tilson et al. | 4/576 |
| 2,847,680 | 8/1958 | Dornack | 4/589 |
| 3,616,467 | 11/1971 | Drain | 4/604 |
| 3,711,872 | 1/1973 | Jarosinski | 4/604 |
| 3,900,902 | 8/1975 | Jarosinski | 4/590 |
| 4,521,926 | 6/1985 | Kuether | 4/579 |

*Primary Examiner*—Henry K. Artis

*Attorney, Agent, or Firm*—Andrus, Sceales, Starke & Sawall

[57] ABSTRACT

A bathtub unit (1) is provided which is set into wall recesses which may form a shower stall if desired. The tub unit includes a raised seat (12) at one end and a downwardly recessed tub (13) at the other end. The front wall of the seat is recessed rearwardly (16) to provide heel room for the user, and the seat top is provided with a drain run (18) which discharges into the tub. A plurality of foot holds (28) are spaced along the longitudinal side walls of the tub, and in the present embodiment comprise vertically extending tapered recesses (29, 30) provided with foot stops (31). Hand rails (32) are disposed along the longitudinal tub edges above the foot holds, with the rails having projections (34) spaced therealong. The user can work himself down into or up from the tub in a step-by-step manner by utilizing one or the combination of foot holds and hand rails.

7 Claims, 5 Drawing Figures

BATHTUB UNIT WITH IMPROVED USER FEATURES

BACKGROUND AND SUMMARY OF THE INVENTION

This invention relates to a bathtub unit with improved user features, and provides improved concepts over my prior U.S. Pat. Nos. 3,711,872 dated Jan. 23, 1973 and 3,900,902 dated Aug. 26, 1975. The prior patents disclose various bathing apparatus having raised seats and other apparatus for the convenience of bathers who may have difficulty in using a conventional bathtub or shower.

The present invention is directed to a bathtub unit which includes a number of features which differ from those of the prior patents, and which even more greatly facilitate use by pregnant women, the handicapped and elderly.

In accordance with the various aspects of the invention, a bathtub is provided which is set into wall recesses which may form a shower stall if desired. The tub unit includes a raised seat at one end and a downwardly recessed tub at the other end. The front wall of the seat is recessed rearwardly to provide heel room for the user, and the seat top is provided with a drain run which discharges into the tub. A plurality of foot holds are spaced along the longitudinal side walls of the tub, and in the present embodiment comprise vertically extending tapered recesses provided with foot stops. Hand rails are disposed along the longitudinal tub edges above the foot holds, with the rails having projections spaced therealong. The user can work himself down into or up from the tub in a step-by-step manner by utilizing one or the combination of foot holds and hand rails.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
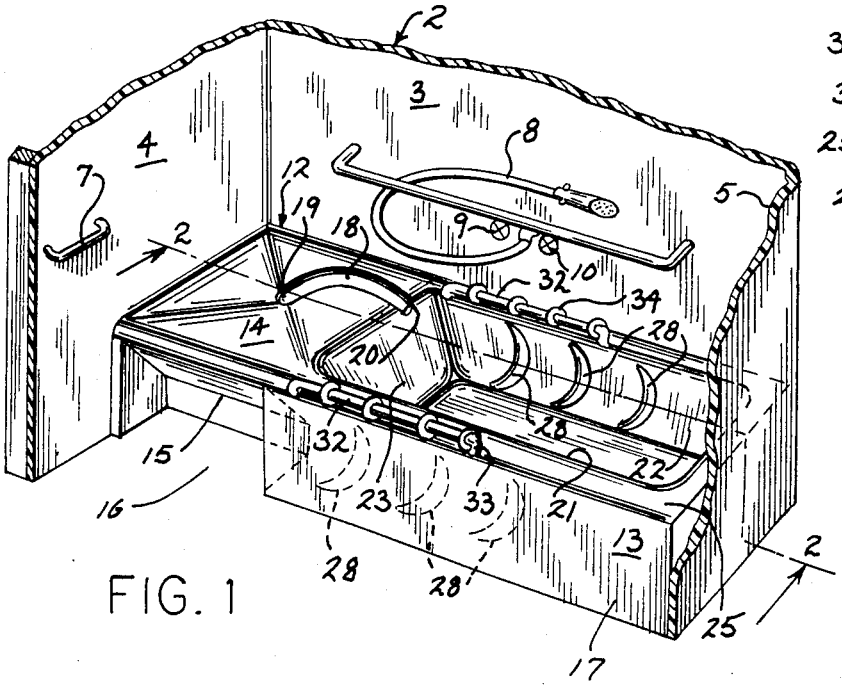
FIG. 1 is a perspective view of a bathtub unit which incorporates the various aspects of the invention.
Figure 3:
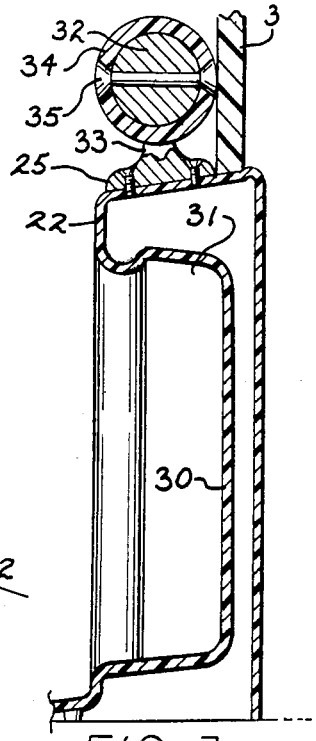
FIG. 3 is a transverse sectional view taken on line 3—3 of FIG. 2.
Figure 2:
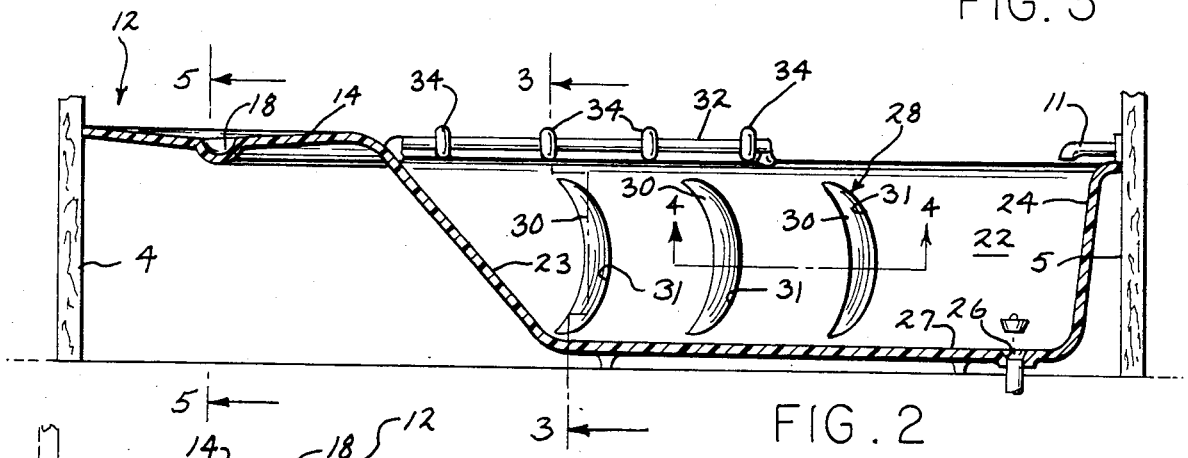
FIG. 2 is a central longitudinal section taken on line 2—2 of FIG. 1.
Figure 5:
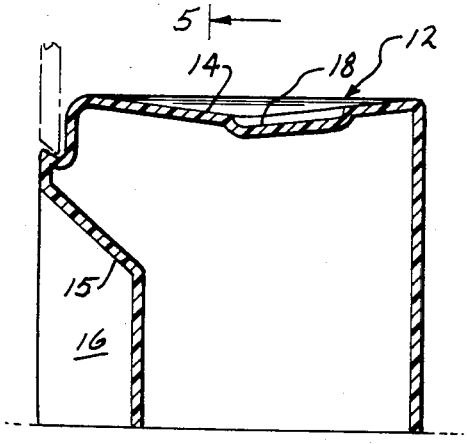
FIG. 5 is a vertical section taken on line 5—5 of FIG. 2.
Figure 4:
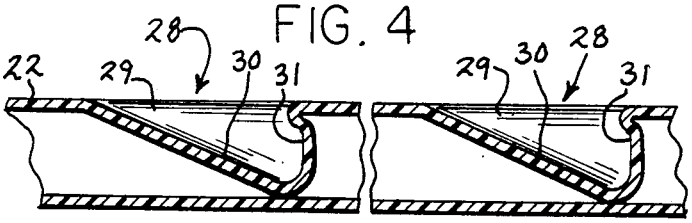
FIG. 4 is an enlarged longitudinal section taken on line 4—4 of FIG. 2 and showing the contour of the foot holds of the present embodiment.

As disclosed in the drawings, the bathtub unit 1 of the invention is adapted to be installed in a recessed wall portion 2 of a room, with the latter comprising a rear wall 3 and end walls 4 and 5. Wall portion 2 may be designed to form a shower stall with a closeable curtain or doors (not shown) in front of tub unit 1. Hand rails 6 and 7 may be disposed on rear wall 3 and end wall 4 to assist the user. A shower hose 8 is mounted to rear wall 3 for connection to suitable plumbing, and with the usual hot and cold water controls 9 and 10. In addition, a water spigot 11 extends inwardly from wall 5 for filling tub unit 1 and is also suitably provided with controls (not shown) for hot and cold water.

Tub unit 1 generally comprises a raised seat portion 12 disposed at one end and a downwardly recessed tub 13 at the other end. Seat portion 12 is disposed adjacent wall 4, and thus hand rail 7, to assist the user in sitting down or standing up therefrom. Seat portion 12 comprises a generally horizontal platform-like seat 14 upon which the user can sit, toqether with a rearwardly inclined front wall portion 15 which forms a forwardly facing recess 16 in the vertical front wall 17 of unit 1 beneath seat 14. Recess 16 forms a heel space so that the user who sits facing forwardly on seat 14 can bend his legs beneath him to a more comfortable position.

Seat 14 is downwardly inclined toward its center for comfort of the user's posterior and is provided with means for draining water from seat portion 12 into tub 13 if the user sprays water upon himself when seated. For this purpose, a water drain run comprising a groove 18 is disposed in seat 14. As shown, groove 18 commences at 19 in the seat center and curves arcuately rearwardly to adjacent wall 3 and terminates in an outlet 20 at one end of tub 13.

Tub 13 generally comprises longitudinal front and rear interior walls 21 and 22 joined by end interior walls 23 and 24. Drain run outlet 20 is disposed at end wall 23. A peripheral platform 25 extends outwardly from the top edges of tub interior walls 21–24, with the platform forming part of seat 14 adjacent wall 23. A drain 26 is also disposed in the tub bottom wall 27.

Entry into tub unit 1 is accomplished by sitting down in a forwardly facing position on seat 14, with the assistance of hand rail 7. Then, using rear hand rail 6 as an assist, the user swings around a quarter turn and raises his leg up and over into tub 13.

If the user is physically able, he may then slide down into the tub. However, in some instances the user may be incapable of normal tub entry. To solve this problem, means are provided to assist the user in entering the tub from a seated position on seat 14. For this purpose, foot hold means are provided in the longitudinal front and rear walls 21 and 22 of the tub. In the present embodiment, each wall 21, 22 includes a plurality of longitudinally spaced foot holds 28. Although three foot holds are shown in each wall, any suitable number may be used. As shown, each foot hold 28 comprises a recess 29 formed by a longitudinally extending outwardly tapered portion 30 formed in the respective wall 21, 22. The tapered portion 30 terminates in an end remote from wall 23 in an elongated generally vertically extending arcuate foot stop 31 formed by a transverse wall in the tub which faces wall 23. The foot holds 28 on the front and rear tub walls 21, 22 are transversely aligned.

When the user slides down into the tub, he engages the first pair of transversely aligned foot holds 18 with his two feet to arrest his movement, and then slides down a short distance so that is feet engage the next pair of foot holds, and so on, in a step-by-step movement, until he is fully seated in the tub.

Hand-graspable means, complimenting foot stops 28, are provided to assist the user in entering the tub. For this purpose, a hand rail 32 is suitably fixedly mounted as by brackets 33 to each tub platform 25 and extends therealong, especially at the end adjacent tub end wall 23. Each hand rail 32 is provided with longitudinally spaced projections or enlargements which form hand stops complimenting foot holds 28. As shown, the hand stops comprise a series of spaced rings 34 which are affixed to rails 32 by bolts 35. When the user slides down into the tub in small increments, he not only stops himself by engaging progressive foot holds 28 with his feet, but also by engaging progressive rings 34 with his hands.

The construction is such that the user can remove himself from the tub by the reverse procedure.

Various modes of carrying out the invention are contemplated as being within the scope of the following claims particularly pointing out and distinctly claiming the subject matter which is regarded as to the invention.

I claim:

1. A bathing apparatus comprising, in combination:

(a) a bathtub unit (1) including a raised seat portion (12) and a downwardly recessed bathtub (13) disposed adjacent said seat portion (12), and with said bathtub unit (1) having a generally vertical front wall (17), (b) said bathtub (13) having front and rear longitudinally extending interior walls (21, 22), a first interior end wall (23) disposed adjacent said seat portion (12) and a second interior end wall (24) disposed remote from said seat portion (12), (c) a bather's seat (14) forming a part of said seat portion (12), (d) recess means (16) disposed in said front wall (17) adjacent said seat (14) and providing a heel space for a forwardly facing seated user to bend his legs beneath, (e) a water drain run comprising a groove (18) disposed in said seat (14), with said groove commencing adjacent the center (19) of said seat and curving arcuately rearwardly and terminating in an outlet (20) at said first tub end wall (23) for draining water into said tub (13), (f) and means to assist the user in entering said tub (13) from a seated position on said seat (14), (g) said user assisting means including a plurality of transversely aligned longitudinally spaced foot holds (28) disposed in said front and rear tub walls (21, 22), and with a said foot hold comprising a longitudinally extending outwardly tapered tub wall portion (30) terminating at an end remote from said first tub end wall (23) in a generally vertically extending transverse foot stop (31) facing said first wall (23), (h) said foot holds being complimented by hand-graspable means mounted to said tub (13) and including hand rails (32) disposed along said front and rear tub walls (21, 22) and adjacent said first end wall (23), and a series of rings (34) fixedly spaced along said hand rails and forming hand stops, (i) said user assisting means forming means facilitating step-by-step incremental entry and exit from said tub (13).

2. A bathing apparatus comprising, in combination:

(a) a bathtub unit (1) including a raised seat portion (12) and a downwardly recessed bathtub (13) disposed adjacent said seat portion (12), and with said bathtub unit (1) having a generally vertical front wall (17), (b) said bathtub (13) having front and rear longitudinally extending interior walls (21, 22), a first interior end wall (23) disposed adjacent said seat portion (12) and a second interior end wall (24) disposed remote from said seat portion (12), (c) a bather's seat (14) forming a part of said seat portion (12), (d) recess means (16) disposed in said front wall (17) adjacent said seat (14) and providing a heel space for a forwardly facing seated user to bend his leg beneath, (e) and a water drain run comprising a groove (18) disposed in said seat (14), with said groove commencing adjacent the center (19) of said seat and curving arcuately rearwardly and terminating in an outlet (20) at said first tub interior end wall (23) for draining the water into said tub (13).

3. A bathing apparatus comprising, in combination:

(a) a bathtub unit (1) including a raised seat portion (12) and a downwardly recessed bathtub (13) disposed adjacent said seat portion (12), and with said bathtub unit (1) having a generally vertical front wall (17), (b) said bathtub (13) having front and rear longitudinally extending interior walls (21, 22), a first interior end wall (23) disposed adjacent said seat portion (12) and a second interior end wall (24) disposed remote from said seat portion (12), (c) a bather's seat (14) forming a part of said seat portion (12), (d) and a plurality of transversely aligned longitudinally spaced foot holds (28) disposed in said front and rear tub walls (21, 22), (e) said foot holds forming means to facilitate step-by-step incremental entry into and exit by the user from said tub (13).

4. The bathing apparatus of claim 3 in which said footholds comprise a longitudinally extending outwardly tapered tub wall portion (30) terminating at an end remote from said first tub end wall (23) in a generally vertically extending transverse foot stop (31) facing said first wall (23).

5. The bathing apparatus of claim 3 which includes hand-graspable means (32, 34) mounted to said tub (13) for further facilitating step-by-step incremental entry into and exit by the user from said tub (13).

6. The bathing apparatus of claim 4 which includes hand-graspable means (32, 34) mounted to said tub (13) for further facilitating step-by-step incremental entry into and exit by the user from said tub (13).

7. The bathing apparatus of claim 6 in which said hand-graspable means comprises:

(a) hand rails (32) disposed along said front and rear tub walls (21, 22) and adjacent said first end wall (23), (b) and a series of projections (34) fixedly spaced along said hand rails and forming hand stops.

* * * * *